US009206498B2

(12) United States Patent
Mataigne et al.

(10) Patent No.: US 9,206,498 B2
(45) Date of Patent: Dec. 8, 2015

(54) GALVANIZED OR GALVANNEALED SILICON STEEL

(75) Inventors: Jean-Michel Mataigne, Senlis (FR); Florence Bertrand, Scy-Chazelles (FR)

(73) Assignees: ArcelorMittal France, Saint Denis (FR); Nippon Steel & Sumitomo Metal Corporation, Tokyo (JP)

( * ) Notice: Subject to any disclaimer, the term of this patent is extended or adjusted under 35 U.S.C. 154(b) by 1162 days.

(21) Appl. No.: 12/666,701

(22) PCT Filed: Jun. 4, 2008

(86) PCT No.: PCT/IB2008/001434

§ 371 (c)(1),
(2), (4) Date: Jun. 14, 2010

(87) PCT Pub. No.: WO2009/004424

PCT Pub. Date: Jan. 8, 2009

(65) Prior Publication Data

US 2010/0282374 A1 Nov. 11, 2010

(30) Foreign Application Priority Data

Jun. 29, 2007 (EP) ..... 07290814

(51) Int. Cl.

| | |
|---|---|
| ***C23C 2/28*** | (2006.01) |
| ***C23C 2/02*** | (2006.01) |
| *C22C 38/00* | (2006.01) |
| *C22C 38/44* | (2006.01) |

(52) U.S. Cl.
CPC .... *C23C 2/02* (2013.01); *C23C 2/28* (2013.01)

(58) Field of Classification Search
USPC ..... 148/320, 335, 533
See application file for complete search history.

(56) References Cited

U.S. PATENT DOCUMENTS

2002/0017342 A1 2/2002 Murakami et al.
2003/0190493 A1 * 10/2003 Nomura et al. ..... 428/659

(Continued)

FOREIGN PATENT DOCUMENTS

| | | | | |
|---|---|---|---|---|
| BE | 1014997 | * | 8/2004 | ..... C23C 2/02 |
| EP | 1 170 391 | | 1/2002 | |
| EP | 1 482 066 | | 12/2004 | |

(Continued)

OTHER PUBLICATIONS

"Galvanneal—Differences from Galvanize." GalvInfo Center. Rev 1.1 Jan. 2011.*

(Continued)

*Primary Examiner* — Kaj K Olsen
*Assistant Examiner* — Alexander Polyansky
(74) *Attorney, Agent, or Firm* — Davidson, Davidson & Kappel, LLC

(57) ABSTRACT

The invention deals with a hot-dip galvanized or galvannealed steel sheet wherein, the composition of the steel sheet comprises, by weight: 0.01≤C≤0.22%, 0.50≤Mn≤2.0%, 0.2≤Si≤3.0%, 0.005≤Al≤2.0%, Mo<1.0%, Cr≤1.0%, P<0.02%, Ti≤0.20%, V≤0.40%, Ni≤1.0%, Nb≤0.20%, the balance of the composition being iron and unavoidable impurities resulting from the smelting, and the steel sheet comprises a layer of an internal nitride of at least one type of nitride selected from a Si nitride, Mn nitride, Al nitride, complex nitride comprising Si and Mn, or Al and Si, or Al and Mn, or complex nitride comprising Si, Mn and Al, said steel sheet comprising no further outer layer of iron nitride.

23 Claims, 1 Drawing Sheet

(56) References Cited

U.S. PATENT DOCUMENTS

| | | | | |
|---|---|---|---|---|
| 2004/0234807 | A1 | 11/2004 | Suzuki et al. | |
| 2009/0123651 | A1 * | 5/2009 | Okada | 427/319 |

FOREIGN PATENT DOCUMENTS

| | | | | |
|---|---|---|---|---|
| FR | 2 661 426 | | 10/1991 | |
| GB | 424 373 | | 2/1935 | |
| GB | 1 396 419 | | 6/1975 | |
| JP | 2003 286561 | | 10/2003 | |
| WO | 97 21846 | | 6/1997 | |
| WO | WO 2007043273 | A1 * | 4/2007 | C23C 2/02 |

OTHER PUBLICATIONS

U.S. Appl. No. 12/666,676, filed Dec. 24, 2009, Bertrand, et al.
U.S. Appl. No. 12/666,702, filed Dec. 24, 2009, Mataigne, et al.

* cited by examiner

GALVANIZED OR GALVANNEALED SILICON STEEL

CROSS-REFERENCE TO RELATED APPLICATIONS

This application is a National Stage of International application No. PCT/IB2008/001434, filed on Jun. 4, 2008.

BACKGROUND OF THE INVENTION

Field of the Invention

The present invention relates to a process for manufacturing a hot-dip galvanized or galvannealed steel sheet containing a high content of silicon.

Before the delivery to car-makers, steel sheets are coated with a zinc-based coating generally performed by hot-dip galvanizing, in order to increase the resistance to corrosion. After leaving the zinc bath, galvanized steel sheets are often submitted to an annealing which promotes the alloying of the zinc coating with the iron of the steel (so-called galvannealing). This kind of coating made of a zinc-iron alloy offers a better weldability than a zinc coating.

To meet the requirement of lightening power-driven ground vehicle structures, it is known to use high tensile strength steel sheet, such as for example TRIP steels (the term TRIP standing for transformation-induced plasticity), which combine very high mechanical strength with the possibility of very high levels of deformation. TRIP steels have a microstructure comprising ferrite, residual austenite and optionally martensite and/or bainite, which allows them to achieve tensile strength from 600 to 1000 MPa. This type of steel is widely used for production of energy-absorbing parts, such as for example structural and safety parts such as longitudinal members and reinforcements.

Most of high strength steel sheet are obtained by adding a large amount of silicon to the steel. Silicon stabilizes the ferrite and improves the yield strength $R_e$ of the steel, and in the case of TRIP steel sheet, it also prevents residual austenite from decomposing to form carbide.

However, when a steel sheet contains more than 0.2% by weight of silicon, they are galvanized with difficulty, because silicon oxides are formed on the surface of the steel sheet during the annealing. These silicon oxides show a poor wettability toward the molten zinc, and deteriorate the plating performance of the steel sheet. To solve this problem, it is known to use high strength steel having low silicon content (less than 0.2% by weight). However, this has a major drawback: a high level of tensile strength, that is to say about 800 MPa, can be achieved only if the content of carbon is increased. But, this has the effect to lower the mechanical resistance of the welded points.

On the other hand, the alloying speed during the galvannealing process is strongly slowed down whatever the TRIP steel composition because of external selective oxidation acting as a diffusion barrier to iron, and the temperature of the galvannealing has to be increased. In the case of TRIP steel sheet, the increase of the temperature of the galvannealing is detrimental to the preservation of the TRIP effect, because of the decomposition of the residual austenite at high temperature. In order to preserve the TRIP effect, a large quantity of molybdenum (more than 0.15% by weight) has to be added to the steel, so that the precipitation of carbide can be delayed. However, this has an effect on the cost of the steel sheet.

Indeed, the TRIP effect is observed when the TRIP steel sheet is being deformed, as the residual austenite is transformed into martensite under the effect of the deformation, and the strength of the TRIP steel sheet increases.

The purpose of the present invention is therefore to remedy the aforementioned drawbacks and to propose a hot-dip galvanized or galvannealed steel sheet having a high silicon content (more than 0.2% by weight), showing high mechanical characteristics.

Further, another purpose of the invention is to propose a process for hot-dip galvanizing or galvannealing a steel sheet having a high silicon content, that guarantees a good wettability of the surface of the steel sheet and no non-coated portions, and thus guarantees a good adhesion and a nice surface appearance of the zinc-based or zinc-iron coating on the steel sheet.

A further purpose of the invention is to preserve the TRIP effect when a TRIP steel sheet is to be galvannealed.

SUMMARY OF THE INVENTION

For this purpose, the first subject of the invention is a hot-dip galvanized or galvannealed steel sheet, wherein the composition of the steel comprises, by weight:

$0.01 \leq C \leq 0.22\%$
$0.50 \leq Mn \leq 2.0\%$
$0.2 \leq Si \leq 3.0\%$
$0.005 \leq Al \leq 2.0\%$
$Mo < 1.0\%$
$Cr \leq 1.0\%$
$P < 0.02\%$
$Ti \leq 0.20\%$
$V \leq 0.40\%$
$Ni \leq 1.0\%$
$Nb \leq 0.20\%$, the balance of the composition being iron and unavoidable impurities resulting from the smelting, and wherein said steel sheet comprises a layer of an internal nitride of at least one type of nitride selected from the group consisting of Si nitride, Mn nitride, Al nitride, complex nitride comprising Si and Mn, complex nitride comprising Si and Al, complex nitride comprising Mn and Al, and complex nitride comprising Si, Mn and Al.

The second subject of the invention is a process for manufacturing this hot-dip galvanized or galvannealed steel sheet, comprising the steps consisting in:

a) subjecting a steel sheet having the above composition, to an annealing in a furnace to form an annealed steel sheet, said furnace comprising:
   - a first heating zone wherein said steel sheet is pre-heated from ambient temperature to a heating temperature T1, in a non nitriding atmosphere having a Dew Point less than −30° C.,
   - a second heating zone wherein said pre-heated steel sheet is heated from said heating temperature T1 to a heating temperature T2, in a nitriding atmosphere having a Dew Point between −30 and −10° C.,
   - a third heating zone wherein said pre-heated steel sheet is further heated from said heating temperature T2 to a soaking temperature T3 in a non nitriding atmosphere having a dew point less than −30° C.,
   - a soaking zone wherein said heated steel sheet is soaked at said soaking temperature T3 for a time t3, in a non nitriding atmosphere having a Dew Point less than −30° C., and a cooling zone wherein said steel sheet is cooled from the soaking temperature T3 to a temperature T4, in a non nitriding atmosphere having a Dew Point less than −30° C., b) hot-dip galvanising said annealed steel sheet to form a zinc-based coated steel sheet, and c) optionally, subjecting said zinc-based coated steel sheet to an alloying treatment to form a galvannealed steel sheet.

DETAILED DESCRIPTION OF THE INVENTION

In order to obtain the hot-dip galvanized or galvannealed steel sheet according to the invention, a steel sheet comprising the following elements is provided:

Carbon with a content between 0.01 and 0.22% by weight. This element is essential for obtaining good mechanical properties, but it must not be present in too large amount in order not to tear the weldability. To encourage hardenability and to obtain a sufficient yield strength $R_e$, and also to form stabilized residual austenite the carbon content must not be less than 0.01% by weight. A bainitic transformation takes place from an austenitic structure formed at high temperature, and ferrite/bainite lamellae are formed. Owing to the very low solubility of carbon in ferrite compared with austenite, the carbon of the austenite is rejected between the lamellae. Owing to silicon and manganese, there is very little precipitation of carbide. Thus, the interlamellar austenite is progressively enriched with carbon without any carbides being precipitated. This enrichment is such that the austenite is stabilized, that is to say the martensitic transformation of this austenite does not take place upon cooling down to room temperature.

Manganese with a content between 0.50 and 2.0% by weight. Manganese promotes hardenability, making it possible to achieve a high yield strength $R_e$. Manganese promotes the formation of austenite, contributes to reducing the martensitic transformation start temperature Ms and to stabilizing the austenite. However, it is necessary to avoid the steel having too high a manganese content in order to prevent segregation, which may be demonstrated during heat treatment of the steel sheet. Furthermore, an excessive addition of manganese causes the formation of a thick internal manganese oxide layer which causes brittleness, and the adhesion of the zinc based coating will not be sufficient.

Silicon with a content between 0.2 and 3.0% by weight. Silicon improves the yield strength $R_e$ of the steel. This element stabilizes the ferrite and the residual austenite at room temperature. Silicon inhibits the precipitation of cementite upon cooling from austenite, considerably retarding the growth of carbides. This stems from the fact that the solubility of silicon in cementite is very low and the fact that silicon increases the activity of the carbon in austenite. Thus, any cementite nucleus that forms will be surrounded by a silicon-rich austenitic region, and rejected to the precipitate-matrix interface. This silicon-enriched austenite is also richer in carbon, and the growth of the cementite is slowed down because of the reduced diffusion resulting from the reduced carbon activity gradient between the cementite and the neighbouring austenitic region. This addition of silicon therefore contributes to stabilizing an amount of residual austenite sufficient to obtain a TRIP effect. During the annealing step to improve the wettability of the steel sheet, internal silicon nitrides and complex nitrides comprising silicon, aluminium and manganese are formed and dispersed under the surface of the sheet. However, an excessive addition of silicon induces unwished external selective oxidation during the soaking, which impairs wettability and galvannealing kinetic.

Aluminium with a content between 0.005 and 2.0% by weight. Like the silicon, aluminium stabilizes ferrite and increases the formation of ferrite as the steel sheet cools down. It is not very soluble in cementite and can be used in this regard to avoid the precipitation of cementite when holding the steel at a bainitic transformation temperature and to stabilize the residual austenite. A minimum amount of aluminium is required in order to deoxidize the steel.

Molybdenum with a content less than 1.0. Molybdenum favours the formation of martensite and increases the corrosion resistance. However, an excess of molybdenum may promote the phenomenon of cold cracking in the weld zones and reduce the toughness of the steel.

When a hot-dip galvannealed steel sheet is wished, conventional process requires the addition of Mo to prevent carbide precipitation during re-heating after galvanizing. Here, thanks to the internal nitriding of silicon, aluminium and manganese, the alloying treatment of the galvanized steel sheet can be performed at a lower temperature than that of conventional galvanized steel sheet comprising no internal nitride. Consequently, the content of molybdenum can be reduced and be less than 0.01% by weight, because it is not necessary to delay the bainitic transformation as it is the case during the alloying treatment of conventional galvanized steel sheet.

Chromium with a content not exceeding 1.0% by weight. The chromium content must be limited in order to avoid surface appearance problems when galvanizing the steel.

Phosphorus with a content not exceeding 0.02% by weight, and preferably not exceeding 0.015% by weight. Phosphorus in combination with silicon increases the stability of the residual austenite by suppressing the precipitation of carbides.

Titanium with a content not exceeding 0.20% by weight. Titanium improves the yield strength of $R_e$, however its content must be limited to 0.20% by weight in order to avoid degrading the toughness.

Vanadium with a content not exceeding 0.40% by weight. Vanadium improves the yield strength of $R_e$ by grain refinement, and improves the weldability of the steel. However, above 0.40% by weight, the toughness of the steel is degraded and there is a risk of cracks appearing in the weld zones.

Nickel with a content not exceeding 1.0% by weight. Nickel increases the yield strength of $R_e$. Its content is generally limited to 1.0% by weight because of its high cost.

Niobium with a content not exceeding 0.20% by weight. Niobium promotes the precipitation of carbonitrides, thereby increasing the yield strength of $R_e$. However, above 0.20% by weight, the weldability and the hot formability are degraded.

The balance of the composition consists of iron and other elements that are usually expected to be found and impurities resulting from the smelting of the steel, in proportions that have no influence on the desired properties.

The steel sheet is first subjected to an annealing to form an annealed steel sheet, before being hot-dip galvanized in a bath of molten zinc and optionally heat-treated to form a galvannealed steel sheet.

Said annealing is performed in a furnace comprising a first heating zone, a second heating zone, a third heating zone and a soaking zone followed by a cooling zone.

The steel sheet is pre-heated in the first heating zone, from ambient temperature to a heating temperature T1, in a non nitriding atmosphere having a Dew Point less than −30° C., in order to form a pre-heated steel sheet.

During the first heating of the steel sheet, it is essential to limit the Dew Point in order to avoid the oxidation of the iron on the surface of the steel, which would impair the wettability.

The heating temperature T1 is preferably between 450 and 550° C. This is because when the temperature is below 450° C., the reaction of selective oxidation of Si, Mn and Al is not possible. As a matter of fact, this reaction is a diffusion controlled mechanism, and is thermally activated. Furthermore, when the temperature of the steel sheet is more than 550° C. during the first heating step, because silicon, aluminium and manganese are more oxidizable than iron, a thin outer layer of Si and/or Al and/or Mn is formed on the surface of the steel sheet. This layer of outer oxide impairs the wettability of the steel sheet.

This pre-heated steel sheet is then heated in the second heating zone, from said heating temperature T1 to a heating temperature T2, in order to form a heated steel sheet. Said heating step is performed in a nitriding atmosphere having a Dew Point between −30 and −10° C., whose effect is to inhibit the superficial oxidation of silicon, aluminium and manganese in decreasing the surface of the steel sheet in free silicon, aluminium and manganese, by precipitation of a layer of an internal nitride of at least one type of nitride selected from the group consisting of silicon nitride, manganese nitride, aluminium nitride, complex nitride comprising silicon and manganese, complex nitride comprising silicon and aluminium, complex nitride comprising manganese and aluminium, and complex nitride comprising silicon, manganese and aluminium. It has to be noted that under these conditions, no further outer layer of iron nitride is formed on the surface of said heated steel sheet. Thus, the wettability of said steel sheet is not impaired.

In the second heating zone, it is essential that the Dew Point is not less than −30° C. This is because the superficial oxidation of silicon, of manganese and of aluminium is not avoided, and the wettability is impaired. However, if the Dew Point is more than −10° C., oxygen adsorption on the steel surface becomes too intense preventing the needed nitrogen adsorption.

The nitriding atmosphere in said second heating zone can comprise 3 to 10% by volume of ammonia ($NH_3$), 3 to 10% by volume of hydrogen, the balance of the composition being nitrogen and unavoidable impurities. If the content is less than 3% by volume of ammonia, the layer of internal nitride is not thick enough to improve the wettability, while an excess of ammonia leads to the formation of a thick layer, and the mechanical characteristics of the steel are impaired.

During the second heating step, the dissociation of ammonia on the surface of steel allows a creation of a flow of nitrogen which penetrates in the steel sheet. This flow of nitrogen leads to the internal nitriding of silicon, aluminium and manganese, and avoids the outer oxidation of silicon, aluminium and manganese.

The heating temperature T2 is preferably between 480 and 720° C.

The heated steel sheet is then further heated in the third heating zone to a soaking temperature T3, soaked in the soaking zone at said soaking temperature T3 for a time t3, and is subsequently cooled down from the soaking temperature T3 to a temperature T4.

The atmosphere in the third heating zone, soaking zone and cooling zone is an atmosphere, whose Dew Point is less than −30° C., so that the oxidation of the steel sheet is avoided, thus the wettability is not impaired.

The atmosphere in the first and third heating zones, soaking zone and cooling zone is a non nitriding atmosphere which can comprise 3 to 10% by volume of hydrogen, the balance of the composition being nitrogen, and unavoidable impurities.

Indeed, with a complete nitriding annealing, that is to say if the atmosphere in the first heating, second heating, third heating, soaking and cooling zones is a nitriding atmosphere, an outer iron nitride layer of about 10 μm is formed on the layer of internal nitride. Thus, the wettability, the mechanical characteristics and the formability of the steel sheet will be impaired.

In order to obtain a hot-dip galvanized or galvannealed steel sheet having a TRIP microstructure comprising ferrite, residual austenite, and optionally martensite and/or bainite, said soaking temperature T3 is preferably between 720 and 850° C., and the time t3 is preferably between 20 and 180 s. Thus, the heating temperature T2 is between T1 and T3.

When the steel sheet is at the temperature T3, a dual phase structure composed of ferrite and austenite is formed. When T3 is above 850° C., the volume ratio of austenite grows too much, and external selective oxidation of surface of the steel occurs. But when T3 is below 720° C., the time required to form a sufficient volume ratio of austenite is too high.

Under these conditions, said internal nitride is preferably formed at a depth between 2.0 and 12.0 μm from the surface of the steel sheet If the time t3 is longer than 180 s, the austenite grains coarsen and the yield strength $R_e$ of the steel after forming will be limited. Furthermore, the hardenability of the steel is reduced and external selective oxidation on surface of the steel can occur. However, if the steel sheet is soaked for a time t3 less than 20 s, the proportion of austenite formed will be insufficient and sufficient residual austenite and optionally martensite and/or bainite will not form during cooling.

The heated steel sheet is cooled at a temperature T4 near the temperature of the bath of molten zinc, in order to avoid the cooling or the re-heating of said bath. T4 is thus between 460 and 510° C. Therefore, a zinc-based coating having a homogenous structure can be obtained.

When the steel sheet is cooled, it is hot dipped into the bath of molten zinc whose temperature is preferably between 450 and 500° C.

When a hot-dip galvanized steel sheet is required, the content of molybdenum in the steel sheet can be more than 0.01% by weight (but always limited to 1.0% by weight), and the bath of molten zinc preferably contains 0.14 to 0.3% by weight of aluminium, the balance being zinc and unavoidable impurities. Aluminium is added in the bath in order to inhibit the formation of interfacial alloys of iron and zinc which are brittle and thus cannot be shaped. When the strip is immersed into the zinc bath, a thin layer of $Fe_2Al_5$ (thickness less than 0.2 μm) is formed at the interface between steel and zinc. This layer insures a good adhesion of zinc to the steel, and can be shaped due to its very thin thickness. However, if the content of aluminium is more than 0.3% by weight, the surface appearance of the wiped coating is impaired because of a too intense growth of aluminium oxide on the surface of the liquid zinc.

When leaving the bath, the steel sheet is wiped by projection of a gas, in order to adjust the thickness of the zinc-based coating. This thickness, which is generally between 3 and 20 μm, is determined according to the required resistance to corrosion.

When a hot-dip galvannealed is required, the content of molybdenum in the steel sheet is preferably less than 0.01% by weight, and the bath of molten zinc preferably contains 0.08 to 0.135% by weight of dissolved aluminium, the balance being zinc and unavoidable impurities. Aluminium is added in the bath in order to deoxidize the molten zinc, and to make it easier to control the thickness of the zinc-based coating. In that condition, precipitation of delta phase ($FeZn_7$) is induced along the interface between steel and zinc.

When leaving the bath, the steel sheet is wiped by projection of a gas, in order to adjust the thickness of the zinc-based coating. This thickness, which is generally between 3 and 10 μm, is determined according to the required resistance to corrosion. Said zinc-based coated steel sheet is finally hot-treated so that a coating made of a zinc-iron alloy is obtained, by diffusion of the iron from steel to the zinc of the coating.

This alloying treatment can be performed by maintaining said steel sheet at a temperature T5 between 460 and 510° C. for a soaking time t5 between 10 and 30 s. Thanks to the absence of external selective oxidation of silicon, aluminium and manganese, this temperature T5 is lower than the conventional alloying temperatures. For that reason, large quantities of molybdenum to the steel are not required, and the content of molybdenum in the steel can be limited to less than 0.01% by weight. If the temperature T5 is below 460° C., the alloying of iron and zinc is not possible. If the temperature T5 is above 510° C., it becomes difficult to form stable austenite, because of the unwished carbide precipitation, and the TRIP effect cannot be obtained. The time t5 is adjusted so that the average iron content in the alloy is between 8 and 12% by weight, which is a good compromise for improving the weldability of the coating and limiting the powdering while shaping.

EXAMPLES

A preferred embodiment of the present invention will be elucidated with reference to the drawings, in which.

Figure 1:
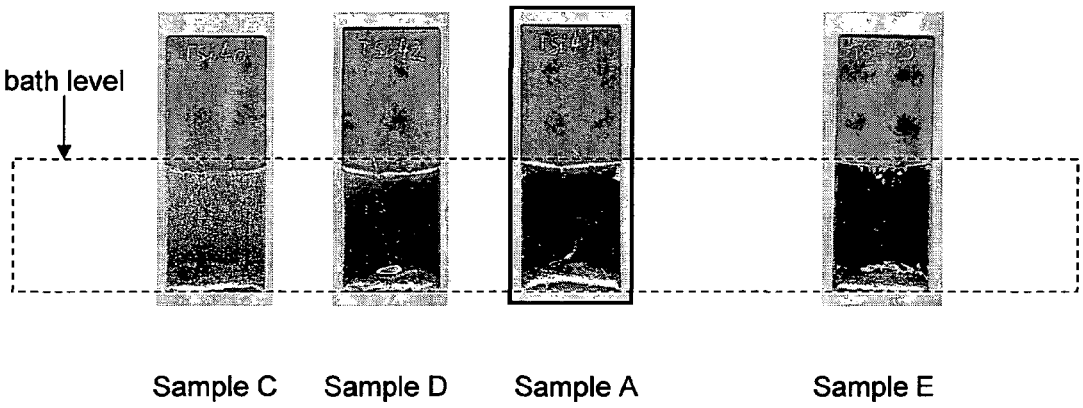
FIG. 1 shows a photograph of samples A, C, D and E.
Figure 2:
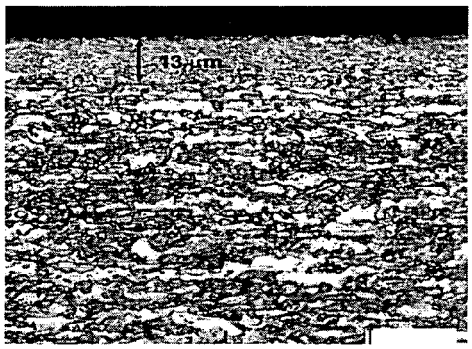
FIG. 2 shows a micrography of a sectional view of a sample A according to the present invention.
Figure 3:
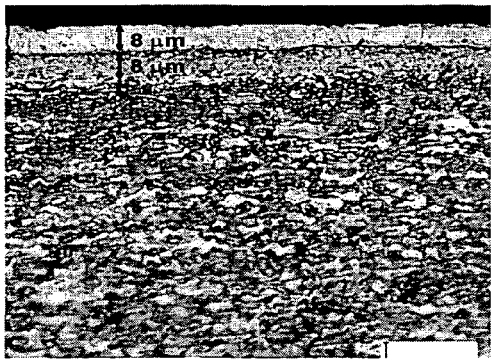
FIG. 3 shows a micrography of a sectional view of sample E annealed in a nitriding atmosphere.

The invention will now be illustrated by examples given by way of non-limiting indication and with reference to FIGS. 1, 2 and 3.

A first trial was carried out using samples (A to E) coming from 0.8 mm thick sheet manufactured from a steel whose composition is given in the table I. The annealing of the steel sheet is performed in a radiant tube furnace comprising a first heating zone, a second heating zone, a third heating zone, and a soaking zone followed by a cooling zone.

Table I: chemical composition of the steel sheet according to the invention, in % by weight, the balance of the composition being iron and unavoidable impurities (samples A to E).

TABLE I

| C | Mn | SI | Al | Mo | Cr | P | Ti | V | Ni | Nb |
|---|---|---|---|---|---|---|---|---|---|---|
| 0.20 | 1.73 | 1.73 | 0.01 | 0.005 | 0.02 | 0.01 | 0.005 | 0.005 | 0.01 | 0.005 |

The wettability and the adherence of a sample A annealed according to the invention is first compared with the wettability and adherence of sample B conventionally annealed and hot-dip galvanized. Comparison is also carried out with samples C, D and E which have been annealed with an annealing comprising at least one step performed under nitriding atmosphere but with conditions different from the invention. The results are shown in table II.

1—Production of Hot-Dip Annealed Steel Sheets According to the Invention

Sample A is heated from ambient temperature (T=20° C.) to 500° C., in the first heating zone wherein the atmosphere has a Dew Point of −40° C. The atmosphere in said first heating zone comprises 5% by volume of hydrogen, the balance being nitrogen and unavoidable impurities.

Then sample A is heated from 500° C. to 700° C., in the second heating zone wherein the atmosphere has a Dew Point of −20° C. The atmosphere in said second heating zone is a nitriding atmosphere and comprises 8% by volume of ammonia, 5% by volume of hydrogen, the balance being nitrogen and unavoidable impurities.

Finally, sample A is further heated from 700° C. to 800° C. in the third heating zone, and soaked at 800° C. for 50 s in the soaking zone, and then cooled down to 460° C. in the cooling zone. The atmosphere in the third heating zone, in the soaking zone and in the cooling zone has a Dew Point of −40° C., and comprises 5% by volume of hydrogen, the balance being nitrogen and unavoidable impurities.

2—Production of a Conventional Annealed Steel Sheet

Sample B is conventionally annealed in a non nitriding atmosphere. It is heated from ambient temperature (T=20° C.) to 800° C., in the first, second and third zones wherein the atmosphere has a Dew Point of −40° C.

Then sample B is soaked at 800° C. for 50 s in the soaking zone, and then cooled down to 460° C. in the cooling zone. The atmosphere in the soaking and cooling zones has a Dew Point of −40° C.

The atmosphere in said first heating, second heating, third heating, soaking and cooling zones comprises 5% by volume of hydrogen, the balance being nitrogen and unavoidable impurities.

3–Production of Annealed Steel Sheets where the Annealing Comprises at Least One Step Performed Under Nitriding Atmosphere Sample C is heated from ambient temperature (T=20° C.) to 500° C., in the first heating zone wherein the atmosphere has a Dew Point of −40° C. The atmosphere in said first heating zone comprises 5% by volume of hydrogen, the balance being nitrogen and unavoidable impurities.

Then, sample C is heated from 500 to 600° C., in the second heating zone wherein the atmosphere has a Dew Point of −20° C. The atmosphere in said second heating zone is a nitriding atmosphere and comprises 8% by volume of ammonia, 5% by volume of hydrogen, the balance being nitrogen and unavoidable impurities.

Finally, sample C is heated from 600 to 800° C. in the third heating zone, and soaked at 800° C. for 50 in the soaking zone, and is cooled down to 460° C. in the cooling zone. The atmosphere in the third heating, soaking and cooling zones has a Dew Point of −40° C., and comprises 5% by volume of hydrogen, the balance being nitrogen and unavoidable impurities.

Sample D is heated from ambient temperature (T=20° C.) to 600° C., in the first heating zone wherein the atmosphere has a Dew Point of −40° C. The atmosphere in said first heating zone comprises 5% by volume of hydrogen, the balance being nitrogen and unavoidable impurities.

Then, sample D is heated from 600 to 700° C., in the second heating zone wherein the atmosphere has a Dew Point of −20° C. The atmosphere in said second heating zone is a nitriding atmosphere and comprises 8% by volume of ammonia, 5% by volume of hydrogen, the balance being nitrogen and unavoidable impurities.

Finally, sample D is further heated from 700 to 800° C. in the third heating zone, and soaked at 800° C. for 50 in the soaking zone, and is cooled down to 460° C. in the cooling zone. The atmosphere in the third heating, soaking and cooling zones has a Dew Point of −40° C., and comprises 5% by volume of hydrogen, the balance being nitrogen and unavoidable impurities.

Sample E is heated from ambient temperature (T=20° C.) to 800° C., in the first, second and third heating zones, soaked at 800° C. for 50 in the soaking zone, and then cooled down to 460° C. in the cooling zone. The atmosphere in said first heating, second heating, third heating, soaking and cooling zones has a Dew Point of −20° C. It is a nitriding atmosphere comprising 8% by volume of ammonia, 5% by volume of hydrogen, the balance being nitrogen and unavoidable impurities.

After cooling, samples A, B, C, D and E are hot dip galvanized in a molten zinc bath comprising 0.12% by weight of aluminium, the balance being zinc and unavoidable impurities. The temperature of said bath is 460° C. After wiping with nitrogen and cooling the zinc coating, the thickness of the zinc coating is 7 μm.

FIG. 1 is a photograph of samples A, C, D and E which have been hot-dip galvanized. The doted line represents the level of the bath. The zinc-based coating is represented below this line.

TABLE II

| | Wettabilty | Adherence | Aspect of the surface |
|---|---|---|---|
| Sample A* | Good | Good | Good |
| Sample B** | Bad | Bad | Bad |
| Sample C | Bad | Bad | Bad |
| Sample D | Medium | Medium | Medium |
| Sample E | Medium | Medium | Medium |

*according to the invention

**according to the conventional process

FIG. 2 represents a microphotography of a sectional view of sample A annealed according to the invention, where it can be seen that the steel sheet comprises a layer of internal nitride having a thickness of 13 μm.

FIG. 3 represents a microphotography of a sectional view of sample E annealed in a nitriding atmosphere, where it can be seen that the steel sheet comprises a layer of internal nitride having a thickness of 8 μm and a further outer layer of iron nitride having a thickness of 8 μm.

Sample A which has been hot dip galvanized is then subjected to an alloying treatment by heating it to 480° C., and by maintaining it at this temperature for 19 s. The inventors have checked that the TRIP microstructure of the obtained hot dip galvannealed steel sheet according to the invention was not lost by this alloying treatment.

In order to obtain the alloying of the zinc-based coating of sample B, it is necessary to heat it to 540° C., and to maintain it at this temperature for 20 s. With such a treatment, the inventors have checked that carbide precipitation occurs, residual austenite is no more kept during cooling down to room temperature and that the TRIP effect has disappeared.

The invention claimed is:

1. A process for manufacturing a hot-dip galvanized or galvannealed steel sheet, comprising:

a) subjecting a steel sheet having a composition comprising by weight:

0.01≤C≤0.22%
0.50≤Mn≤2.0%
0.2≤Si≤3.0%
0.005≤Al≤2.0%
Mo<1.0%
Cr≤1.0%
P<0.02%
Ti≤0.20%
V≤0.40%
Ni≤1.0%
Nb≤0.20%, wherein the balance of the composition is iron and unavoidable impurities resulting from smelting, to an annealing in a furnace to form an annealed steel sheet, wherein the furnace comprises:

a first heating zone wherein the steel sheet is pre-heated from ambient temperature to a heating temperature T1, in a non nitriding atmosphere having a Dew Point less than −30° C., a second heating zone wherein the pre-heated steel sheet is heated from the heating temperature T1 to a heating temperature T2, in a nitriding atmosphere having a Dew Point between −30 and −10° C., a third heating zone wherein the pre-heated steel sheet is further heated from the heating temperature T2 to a soaking temperature T3, in a non nitriding atmosphere having a Dew Point less than −30° C., a soaking zone wherein the heated steel sheet is soaked at the soaking temperature T3 for a time t3, in a non nitriding atmosphere having a Dew Point less than −30° C. and, a cooling zone wherein the steel sheet is cooled from the soaking temperature T3 to a temperature T4, in a non nitriding atmosphere having a Dew Point less than −30° C., and (b) hot-dip galvanizing the annealed steel sheet to form a zinc-based coated steel sheet.

2. The process of claim 1, wherein the nitriding atmosphere in the second heating zone comprises, by volume, 3 to 10% of ammonia, 3 to 10% of hydrogen, the balance of the composition being nitrogen and unavoidable impurities.

3. The process of claim 1 or 2, wherein the heating temperature T1 is between 450 and 550° C.

4. The process of claim 1 or 2, wherein the heating temperature T2 is between 480 and 750° C.

5. The process of claim 1 or 2, wherein the soaking temperature T3 is between 720 and 850° C.

6. The process of claim 1 or 2, wherein the time t3 is between 20 and 180 s.

7. The process of claim 1 or 2, wherein the non nitriding atmosphere in the first heating, third heating, soaking and cooling zones comprises 3 to 10% by volume of hydrogen, the balance of the composition being nitrogen, and unavoidable impurities.

8. The process of claim 1 or 2, wherein the temperature T4 is between 460 and 510° C.

9. The process of claim 1 or 2, wherein a hot-dip galvanized steel sheet is produced, and wherein the hot-dip galvanizing is performed by hot-dipping the reduced steel sheet in a molten bath comprising from 0.14 to 0.3% by weight of aluminum, the balance being zinc and unavoidable impurities.

10. The process of claim 1 or 2, wherein a hot-dip galvannealed steel sheet is produced, and wherein the hot-dip galvanizing is performed by hot-dipping the reduced steel sheet in a molten bath comprising from 0.08 to 0.135% by weight of aluminum, the balance being zinc and unavoidable impurities.

11. The process of claim 10, wherein the content of molybdenum of the steel sheet is less than 0.01% by weight.

12. The process of claim 10, wherein the alloying treatment is performed by heating the zinc-based coated steel sheet at a temperature T5 between 460 and 510° C. for a soaking time t5 between 10 and 30 s.

13. The process of claim 11, wherein the alloying treatment is performed by heating the zinc-based coated steel sheet at a temperature T5 between 460 and 510° C. for a soaking time t5 between 10 and 30 s.

14. The process of claim 9, wherein the temperature of the molten bath is between 450 and 500° C.

15. The process of claim 10, wherein the temperature of the molten bath is between 450 and 500° C.

16. The process of claim 1, wherein the steel sheet has a TRIP microstructure comprising ferrite and residual austenite.

17. The process of claim 1, wherein the steel sheet comprises at least one layer of an internal nitride of at least one type of nitride selected from the group consisting of Si nitride, Mn nitride, Al nitride, complex nitride comprising Si and Mn and complex nitride comprising Si, Mn and Al.

18. The process of claim 17, wherein the layer of internal nitride is formed at a depth between 2.0 and 12.0 μm from the surface of the steel sheet.

19. The process of claim 17, wherein the steel sheet comprises no further layer of iron nitride.

20. The process of claim 1 further comprising:

(c) subjecting the zinc-based coated steel sheet to an alloying treatment to form a galvannealed steel sheet.

21. The process of claim 16, wherein the TRIP microstructure includes martensite or bainite.

22. The process of claim 16, wherein the TRIP microstructure includes martensite and bainite.

23. The process of claim 1 wherein ammonia is introduced to form the nitriding atmosphere.

* * * * *